US008676068B2

(12) United States Patent
Kim

(10) Patent No.: US 8,676,068 B2
(45) Date of Patent: Mar. 18, 2014

(54) IMAGE FORMING APPARATUS AND FIXING UNIT CONTROL METHOD THEREOF

(75) Inventor: Su-hwan Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 199 days.

(21) Appl. No.: 13/137,147

(22) Filed: Jul. 22, 2011

(65) Prior Publication Data

US 2012/0121277 A1 May 17, 2012

(30) Foreign Application Priority Data

Nov. 15, 2010 (KR) ..... 10-2010-0113243
Jul. 1, 2011 (KR) ..... 10-2011-0065259

(51) Int. Cl.
*G03G 15/20* (2006.01)

(52) U.S. Cl.
USPC ..... 399/33; 399/88

(58) Field of Classification Search
USPC ..... 399/33, 88
See application file for complete search history.

(56) References Cited

U.S. PATENT DOCUMENTS

2007/0122170 A1* 5/2007 Mashiba ..... 399/33

FOREIGN PATENT DOCUMENTS

JP 2003-057116 2/2003
JP 2004-028622 1/2004

OTHER PUBLICATIONS

Extended European Search Report dated Apr. 2, 2012 issued in corresponding European Patent Application No. 11177029.3.
Patent Abstracts of Japan, Publication No. 2003-057116, Published Feb. 26, 2003.
Patent Abstracts of Japan, Publication No. 2004-028622, Published Jan. 29, 2004.

* cited by examiner

*Primary Examiner* — Hoang Ngo
(74) *Attorney, Agent, or Firm* — Staas & Halsey LLP

(57) ABSTRACT

An image forming apparatus including: an image forming unit which forms an image; a fixing unit which fixes the image transferred to a printing medium; a power supply which supplies operation power to the fixing unit; a contactless sensor sensing a temperature of the fixing unit and respectively outputting a sensor-sensing voltage and a sensor-compensating voltage; and a contactless-sensing protector which shuts off the power if the sensor-sensing voltage is higher than the sensor-compensating voltage. The fixing unit can be protected from overheating and control error through the contactless-sensing protector for sensing the fixing temperature and shutting off the power.

15 Claims, 10 Drawing Sheets

IMAGE FORMING APPARATUS AND FIXING UNIT CONTROL METHOD THEREOF

CROSS-REFERENCE TO RELATED APPLICATIONS

This application claims priority from Korean Patent Application No. 10-2010-0113243, filed on Nov. 15, 2010 in the Korean Intellectual Property Office and Korean Patent Application No. 10-2011-0065259, filed on Jul. 1, 2011 in the Korean Intellectual Property Office, the disclosures each of which are incorporated herein by reference.

BACKGROUND

1. Field

Apparatuses and methods consistent with the exemplary embodiments relate to an image forming apparatus and a fixing unit control method thereof, and more particularly, to an image forming apparatus and a fixing unit control method thereof, which can prevent malfunction of a contactless sensor for sensing temperature of a fixing unit.

2. Description of the Related Art

An image forming apparatus forms an image to be printed on a printing medium. The image forming apparatus may be embodied in a printer, a copy machine, a facsimile, a peripheral having two or more functions, etc.

Specifically, an image forming apparatus 100, such as shown in FIG. 1, forms an image by an image forming unit which includes an image carrying body 121, an optical scanning unit 123 scanning a beam to the image carrying body 121 and forming an electrostatic latent image, a developing unit 125 for developing a toner image corresponding to the latent image formed on the image carrying body 121, and a transfer unit 130 transferring a toner developed on the image carrying body 121 charged with electricity to a printing medium.

An image transferred to the printing medium is thermally pressed by the fixing unit 140 and discharged to the outside. The fixing unit 140 is heated with supplied power and fixes the image on the printing medium.

The image forming apparatus 100 is provided with a temperature sensing unit (or a temperature sensor) that senses temperature of the fixing unit 140 in order to prevent the fixing unit 140 from overheating, and controls power supplied to the fixing unit 140 on the basis of sensing results.

In general, the temperature sensing unit employs a contact sensor contacting a heat roller 141 of the fixing unit 140 and sensing the temperature.

Also, the image forming apparatus is additionally provided with a contact-sensing protector that protects the fixing unit 140 by shutting off power supplied to the fixing unit 140, that is, turning off the fixing unit 140 regardless of a temperature control signal of a controller if the fixing unit 140 supplied with power is abnormally overheated due to a control error or the like reason or if an error occurs in the contact sensor.

However, in the case of the contact sensor, there may arise a problem that a contact part on the surface of the heat roller 141 is different in smoothness from the other parts, a sensed temperature is lower than an actual temperature since a pollutant such as a toner residue, a paper dust, etc. is attached to the contact sensor, and so on.

Recently, a contactless temperature sensor has been provided as an auxiliary means for the contact sensor, or there has appeared a tendency to control the temperature of the fixing unit 140 by using a contact temperature sensor as a sub temperature sensor in the periphery or the like of the fixing unit 140 and a contactless sensor as a main temperature sensor for the fixing unit 140 or by using only the contactless sensor.

A conventional image forming apparatus uses the contact-sensing protector for preventing the fixing unit 140 from overheating, an error, etc. on the basis of the sensing results of the contact sensor, but does not use a circuit for shutting off the power in hardware to prevent the fixing unit 140 from overheating, an error, etc. on the basis of the sensing results of the contactless sensor.

Also, the contact sensor includes a single sensor for sensing temperature, but the contactless sensor includes two sensors, i.e., a thermo-sensitive device for sensing infrared and a thermo-sensitive device for compensating temperature. Therefore, it is impossible to directly apply the contact-sensing protector to a contactless-sensing protector.

Accordingly, as demand for the contactless sensor increases, there is a need for separately providing the image forming apparatus with a contactless-sensing protector that protects the fixing unit 140 in hardware from abnormal overheating, an error due to malfunction of the controller, etc. on the basis of the sensing results of the contactless sensor.

SUMMARY

Accordingly, one or more exemplary embodiments provide an image forming apparatus and a fixing unit control method thereof, in which a contactless-sensing protector for sensing a fixing temperature by a contactless method and shutting off power in hardware is provided to prevent overheating and a control error and protect a fixing unit.

Also, another exemplary embodiment is to provide an image forming apparatus and a fixing unit control method thereof, which can more effectively protect a fixing unit by not only shutting off power on the basis of comparison between a sensor-sensing voltage and a sensor-compensating voltage but also shutting off the power even when at least one of the sensor-sensing voltage and the sensor-compensating voltage is beyond a temperature range.

The foregoing and/or other aspects may be achieved by providing an image forming apparatus including: an image forming unit which forms an image; a fixing unit which fixes the image transferred to a printing medium; a power supply which supplies operation power; a contactless sensor which includes a pair of sensors sensing temperature of the fixing unit by a contactless method and respectively outputting a sensor-sensing voltage and a sensor-compensating voltage; and a contactless-sensing protector which shuts off power supplied from the power supply to the fixing unit if the sensor-sensing voltage is higher than the sensor-compensating voltage.

The contactless-sensing protector may include a first comparator to receive the sensor-sensing voltage and the sensor-compensating voltage and output a comparison result between the received sensor-sensing voltage and sensor-compensating voltage.

The image forming apparatus may further include a memory unit to store a temperature characteristic table about the sensor-sensing voltage and the sensor-compensating voltage, wherein the contactless-sensing protector compares the sensor-sensing voltage and the sensor-compensating voltage output from the contactless sensor with the temperature characteristic table, and shuts off the power supplied from the power supply to the fixing unit if at least one of the output sensor-sensing voltage and sensor-compensating voltage is beyond a range of the temperature characteristic table stored in the memory unit.

The contactless-sensing protector may include a plurality of comparators that receives one of the sensor-sensing voltage and the sensor-compensating voltage, and a voltage set up as an upper limit value or a lower limit value of one of the sensor-sensing voltage and the sensor-compensating voltage.

The plurality of comparators may include a second comparator which receives the output sensor-compensating voltage and the setup upper limit value of the sensor-compensating voltage, and outputs an error signal if the output sensor-compensating voltage is higher than the upper limit value; a third comparator which receives the output sensor-compensating voltage and the setup lower limit value of the sensor-compensating voltage, and outputs an error signal if the output sensor-compensating voltage is lower than the lower limit value; a fourth comparator which receives the output sensor-sensing voltage and the setup upper limit value of the sensor-sensing voltage, and outputs an error signal if the output sensor-sensing voltage is higher than the upper limit value; and a fifth comparator which receives the output sensor-sensing voltage and the setup lower limit value of the sensor-sensing voltage, and outputs an error signal if the output sensor-sensing voltage is lower than the lower limit value, and the contactless-sensing protector shuts off the power supplied from the power supply to the fixing unit if at least one of the second to fifth comparators outputs the error signal.

The image forming apparatus may further include a controller which receives a signal from the contactless-sensing protector and controls operation of the fixing unit.

The image forming apparatus may further include a contact sensor which senses temperature of the fixing unit by a contact method and outputs a contact-sensing voltage; and a contact-sensing protector which shuts off power supplied from the power supply to the fixing unit if the contact-sensing voltage is higher than a predetermined reference voltage.

The contact-sensing protector may include a sixth comparator which receives the contact-sensing voltage and the reference voltage and outputs a comparison result between the received contact-sensing voltage and reference voltage.

The image forming apparatus may further include a controller which receives signals from the contactless-sensing protector and the contact-sensing protector and controls operation of the fixing unit, wherein the controller controls the fixing unit to stop operating on the basis of a signal output from at least one of the contactless-sensing protector and the contact-sensing protector.

Another aspect may be achieved by providing a fixing unit control method of an image forming apparatus including an image forming unit to form an image, a fixing unit to fix the image transferred on a printing medium, and a power supply to supply operation power, the fixing unit control method including sensing temperature of the fixing unit by a contactless method and outputting a sensor-sensing voltage and a sensor-compensating voltage; comparing the sensor-sensing voltage with the sensor-compensating voltage; and shutting off power supplied from the power supply to the fixing unit if the sensor-sensing voltage is higher than the sensor-compensating voltage.

The image forming unit may further include a memory unit to store a temperature characteristic table about the sensor-sensing voltage and the sensor-compensating voltage, the fixing unit control method further including comparing the output sensor-sensing voltage and sensor-compensating voltage with the temperature characteristic table; and shutting off the power supplied from the power supply to the fixing unit if at least one of the output sensor-sensing voltage and sensor-compensating voltage is beyond a range of the temperature characteristic table stored in the memory unit.

The comparison with the temperature characteristic table may include comparing one of the sensor-sensing voltage and the sensor-compensating voltage with a voltage set up as an upper limit value or a lower limit value of one of the sensor-sensing voltage and the sensor-compensating voltage.

The comparison with the voltage setup as the upper limit value or the lower limit value may include a first operation of comparing the output sensor-compensating voltage with the setup upper limit value of the sensor-compensating voltage, and outputting an error signal if the output sensor-compensating voltage is higher than the upper limit value; a second operation of comparing the output sensor-compensating voltage with the setup lower limit value of the sensor-compensating voltage, and outputting an error signal if the output sensor-compensating voltage is lower than the lower limit value; a third operation of comparing the output sensor-sensing voltage with the setup upper limit value of the sensor-sensing voltage, and outputting an error signal if the output sensor-sensing voltage is higher than the upper limit value; and a fourth operation of comparing the output sensor-sensing voltage with the setup lower limit value of the sensor-sensing voltage, and outputting an error signal if the output sensor-sensing voltage is lower than the lower limit value.

The shutting of the power may include shutting off the power supplied from the power supply to the fixing unit if the error signal is output in at least one of the first to fourth operations.

The fixing unit control method may further include outputting a control signal for stopping operation of the fixing unit if the sensor-sensing voltage is higher than the sensor-compensating voltage.

The fixing unit control method may further include sensing temperature of the fixing unit by a contact method and outputs a contact-sensing voltage; comparing the contact-sensing voltage and a predetermined reference voltage; and shutting off power supplied from the power supply to the fixing unit if the contact-sensing voltage is higher than the reference voltage.

The fixing unit control method may further include a control signal for stopping operation of the fixing unit if the contact-sensing voltage is lower than or equal to the reference voltage.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Below, exemplary embodiments will be described in detail with reference to accompanying drawings.

Figure 1:
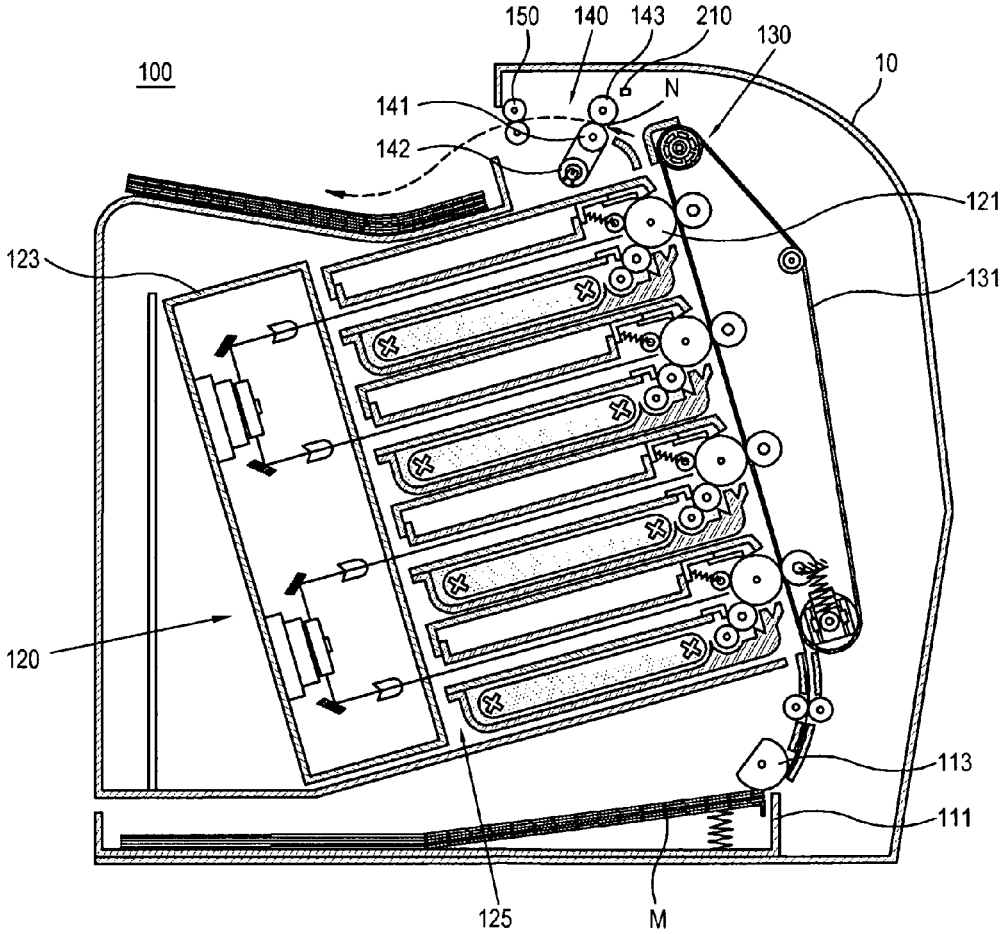
FIG. 1 illustrates an image forming apparatus according to an exemplary embodiment.

FIG. 1 illustrates an image forming apparatus according to an exemplary embodiment.

The image forming apparatus in this exemplary embodiment can be embodied in a printer, a copy machine, a facsimile, a peripheral having two or more functions, etc.

Referring to FIG. 1, the image forming apparatus in the present exemplary embodiment is a tandem type color image forming apparatus for forming a color image by a single-pass method, which includes a developing unit 125 having an image carrying body 121, an optical scanning unit 123, and a transfer unit 130. The developing unit 125, the optical scanning unit 123 and the transfer unit 130 are included in an image forming unit 120, and the image forming unit 120 performs printing in response to a printing command. Here, the printing includes printing for copying after scanning a manuscript, printing for received fax data, and printing for print data received from the outside via a host apparatus including a server or stored in the inside (e.g., a hard disk drive (HDD)) or the outside (e.g., a universal serial bus (USB) memory) of the image forming apparatus.

The image forming apparatus includes a fixing unit 140 for thermally pressing an image transferred to a printing medium (or a recording medium) M, and a discharging unit 150 for discharging the printing medium, on which the image is fixed, to the outside.

A feeding unit 111, in which the printing medium M to be fed is stacked, is detachably provided inside a housing 10 forming an outer appearance of the image forming apparatus. The printing medium M stacked in this feeding unit 111 is picked up by a pickup roller 113, and conveyed toward the transfer unit 130 along a transferring path.

The image carrying body 121 forms latent images corresponding to respective colors in response to a beam scanned from the optical scanning unit 123. In this exemplary embodiment, first to fourth image carrying bodies arranged sequentially in a direction of supplying the printing medium are used as an example of a plurality of image carrying bodies 121.

The developing unit 125 accommodates a toner and forms a toner image on the image carrying body 121.

There may be provided a plurality of developing units 125 corresponding to respective colors. For example, FIG. 1 illustrates the first to fourth developing units to reproduce yellow (Y), magenta (M), cyan (C) and black (K), respectively.

In this exemplary embodiment, the toner is accommodated in the developing unit 125, which is only an example. Alternatively, a developer supplying unit may be separately configured. In this case, the developer supplying unit includes first to fourth developer supplying units corresponding to colors, respectively. Further, the image carrying body 121 is provided in the developing unit 125, but the invention is not limited thereto. Alternatively, the image carrying body may be provided outside the developing unit.

The optical scanning unit 123 scans a beam so that latent images can be formed on the plurality of image carrying bodies 121, respectively. To this end, the optical scanning unit 123 includes a light source, a beam deflector for deflecting the beam emitted from the light source, an imaging lens for scanning the beam deflected by the beam deflector and forming an image, and a reflector for changing a propagating path of the beam scanned by the beam deflector.

The transfer unit 130 transfers a visible image formed on the image carrying body 121 to the printing medium M supplied along a printing path. To this end, the transfer unit 130 may include a transfer belt 131 arranged facing the plurality of image carrying bodies 121.

The image transferred to the printing medium M by the transfer unit 130 is fixed by the fixing unit 140.

The fixing unit 140 forms a fixing nip N using pressure, and fixes the transferred image by heating and pressing the print medium passing through the fixing nip. Specifically, the fixing unit 140 includes a heat roller 141 internally provided with a heater 142 and generating heat, and a press roller 143 closely contacting the heat roller 141 and forming the fixing nip N. The heat roller 141 and the press roller 143 apply heat and pressure to an image transferred on the printing medium M and fix the image while being engaged with each other by a predetermined pressure and rotating.

The heater 142 provided in the heat roller 141 may be achieved by a halogen lamp, a hot wire, an induction heater, etc.

According to an exemplary embodiment, the image forming apparatus further includes a contactless sensor 210 for sensing temperature of the fixing unit 140 by a contactless method.

The contactless sensor 210 is spaced apart from the heat roller 141 of the fixing unit 140 at a predetermined distance, and senses temperature of the fixing unit 140 (i.e., roller) by a contactless method.

Figure 2:
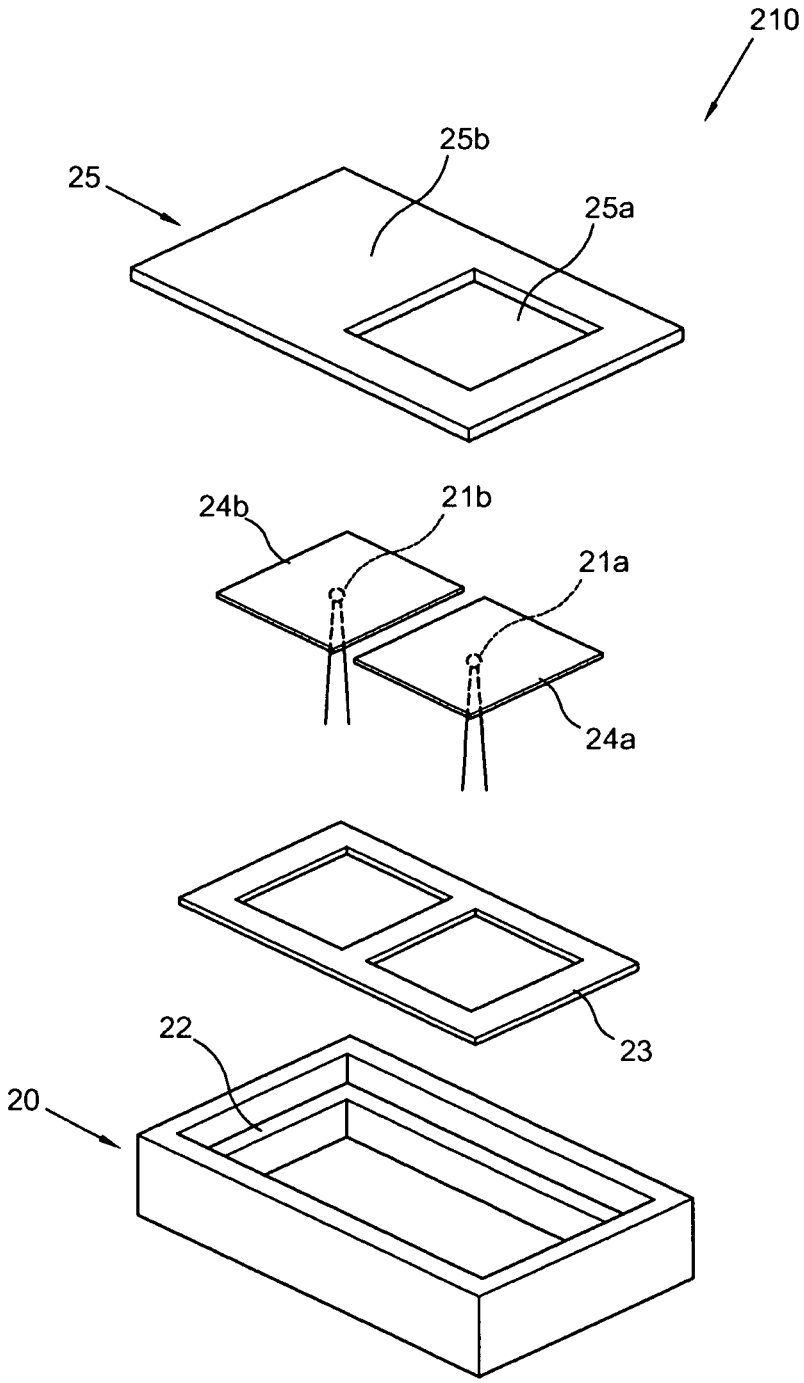
FIG. 2 is an exploded perspective view showing a contactless sensor 210 according to an exemplary embodiment.
Figure 3:
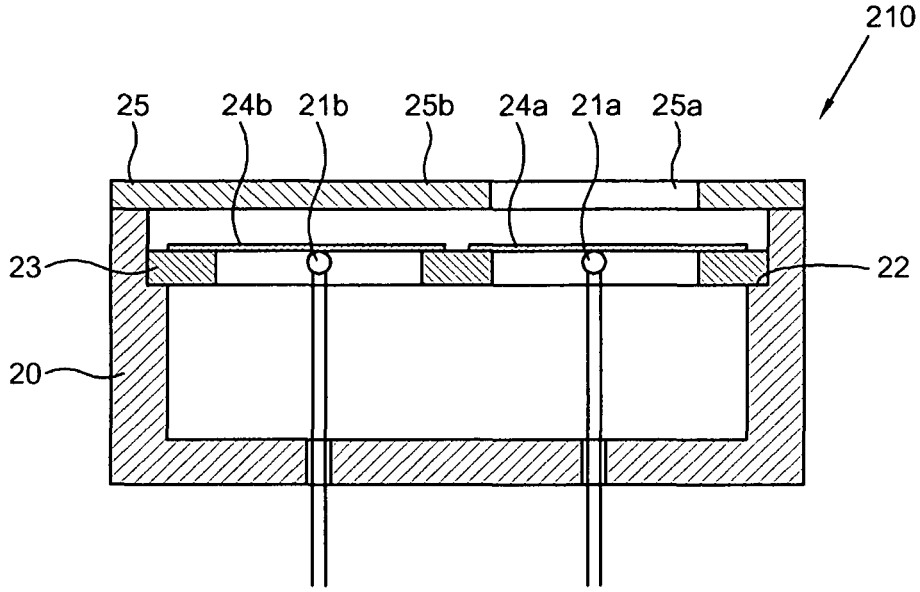
FIG. 3 is a cross-section view showing an assembled state of the contactless sensor 210 according to a second exemplary embodiment of FIG. 2.

FIG. 2 is an exploded perspective view showing the contactless sensor 210 according to an exemplary embodiment, and FIG. 3 is a cross-section view showing an assembled state of the contactless sensor 210 according to a second exemplary embodiment of FIG. 2.

As shown in FIG. 2, the contactless sensor 210 is configured with a pair of spaced sensors, which includes an infrared-sensing thermo-sensitive device 21*a* and a temperature-compensating thermo-sensitive device 21*b*.

The infrared-sensing thermo-sensitive device 21*a* outputs a sensor-sensing voltage NCTH_D, and the temperature-compensating thermo-sensitive device 21*b* outputs a sensor-compensating voltage NCTH_C. The image forming apparatus detects the amount of infrared on the basis of a potential difference between the sensor-sensing voltage and the sensor-compensating voltage, thereby sensing the temperature of the fixing unit 140.

In this exemplary embodiment, the infrared-sensing thermo-sensitive device 21*a* and the temperature-compensating thermo-sensitive device 21*b* are achieved by thermistor devices by way of example, but may alternatively be a thermocouple, a resistance temperature detector (RTD), etc., as long as it can be used as a temperature sensor. Here, the infrared-sensing thermo-sensitive device 21*a* and the temperature-compensating thermo-sensitive device 21*b* have the same shape and characteristics.

Referring to FIGS. 2 and 3, the contactless sensor 210 includes a case 20, resin films 24*a* and 24*b*, a fixing frame 23 for fixing the resin films 24*a* and 24*b*, and a cover unit 25 including an infrared incident window 25*a* and an infrared shield 25*b*. The case 20 is internally formed with a protrusion 22, so that the fixing frame 23 can be fastened by adhesion or a like method. The case 20 and the fixing frame 23 may be made of resin, metal, or etc., which has thermal conductivity, and be formed as a single body.

The resin films 24*a* and 24*b* are formed by dispersing carbon black, inorganic pigment, etc., to a polymer material such as polyester having a predetermined thickness (e.g., 0.2 mm).

The infrared-sensing thermo-sensitive device 21*a* and the temperature-compensating thermo-sensitive device 21*b* are fastened to closely contact one side of the resin film 24*a*, 24*b*.

The cover unit 25 is configured with a structure where the infrared incident window 25*a* is located corresponding to the resin film 24*a* provided with the infrared-sensing thermo-sensitive device 21*a* and the infrared shield 25*b* is located corresponding to the resin film 24*b* provided with the temperature-compensating thermo-sensitive device 21*b*.

FIG. 2 shows an exemplary embodiment in which two resin films 24*a* and 24*b* are provided corresponding to the locations of the infrared-sensing thermo-sensitive device 21*a* and the temperature-compensating thermo-sensitive device 21*b*, but the invention is not limited thereto. Alternatively, one resin film may be provided.

Infrared is emitted to the resin film 24*a* through the infrared incident window 25*a* provided in the cover unit 25 of the case 20. The temperature of the resin film 24*a* increases in accordance with the amount of emitted infrared, and thus the resistance of the infrared-sensing thermo-sensitive device 21*a* closely attached to the rear of the resin film 25*a* is varied. Accordingly, the temperature increase in the resin film 24*a* corresponding to the amount of infrared is output as the variation in resistance. The output variation in the resistance may involve influence of the temperature around the infrared-sensing thermo-sensitive device 21*a*.

Since the temperature-compensating thermo-sensitive device 21*b* is fastened to the resin film 25*b* and shielded from the infrared by the cover unit 25, it is varied in the resistance by circumferential temperature without being affected by the infrared.

That is, both the infrared-sensing thermo-sensitive device 21*a* and the temperature-compensating thermo-sensitive device 21*b* are varied in resistance by their circumferential temperature, and the variation is offset by a separate bridge circuit (not shown). Therefore, it is possible to correctly sense a temperature variation corresponding to the amount of incident infrared.

Thus, the contactless sensor 210 can more correctly sense the temperature variation of the fixing unit 140.

Figure 4:
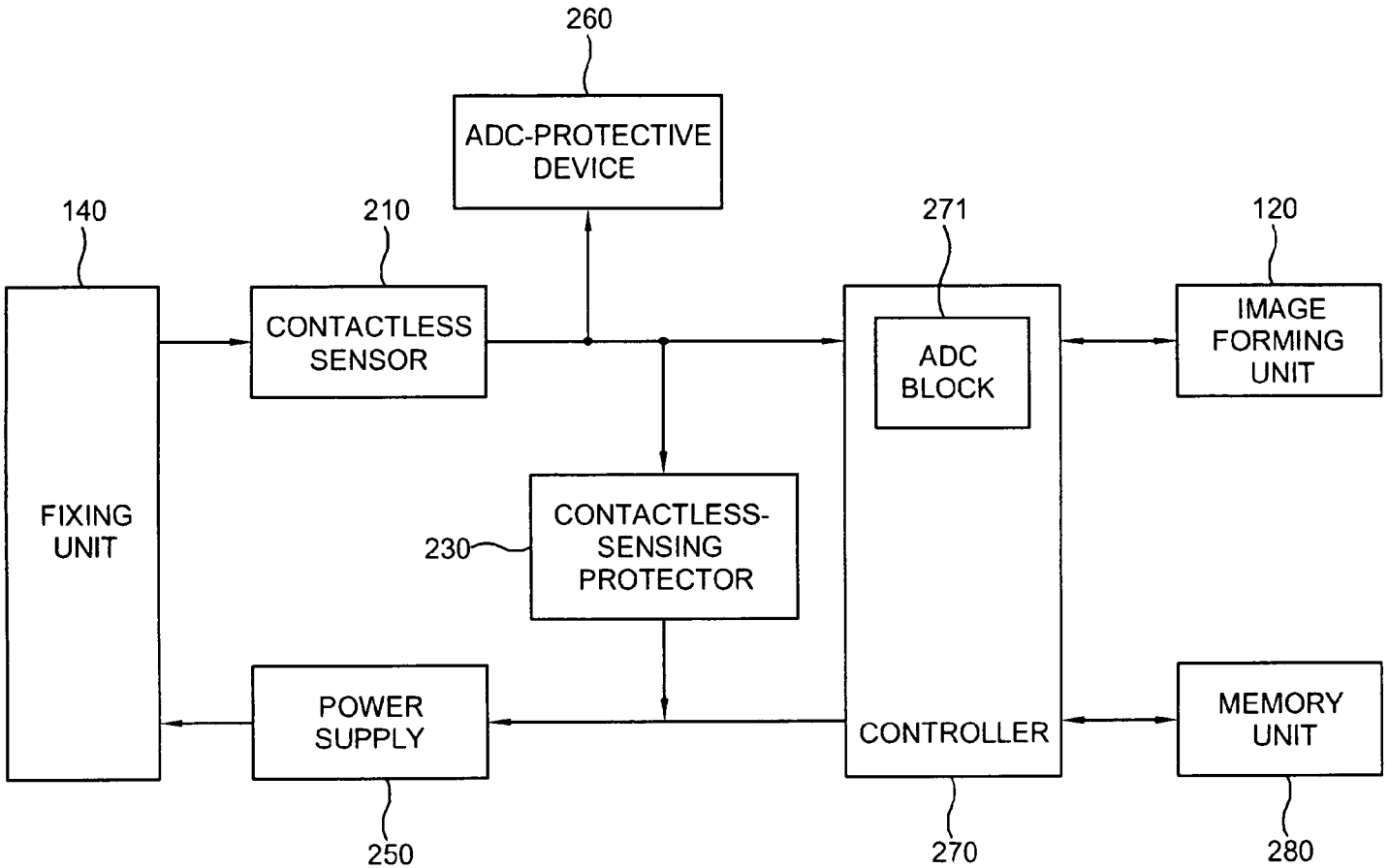
FIG. 4 is a block diagram showing a configuration of an image forming apparatus according to an exemplary embodiment.

FIG. 4 is a block diagram showing a configuration of an image forming apparatus according to an exemplary embodiment. As shown in FIG. 4, the image forming apparatus according to an exemplary embodiment further includes a contactless-sensing protector 230, a memory unit 280, a power supply 250, and a controller 270. The image forming apparatus may additionally include an analog-to-digital converter (ADC)-protective device 260 for preventing electrostatic discharge (ESD) or electric noise.

The contactless sensing protector 230 compares the sensor-compensating voltage with the sensor-sensing voltage sensed by the contactless sensor 210, and shuts off the power supplied from the power supply 250 to the fixing unit 140 on the basis of comparison results.

The memory unit 280 stores a temperature characteristic table of the contactless sensor.

The following table 1 shows an example of a contactless temperature characteristic table. The temperature characteristics shown in the table 1 is given by way of example, and may vary in values depending on the characteristics of the sensor.

TABLE 1

| Compensating temperature (° C.) | Sensor-compensating voltage Vc (V) | Roller temperature (° C.) | | | | | | | |
|---|---|---|---|---|---|---|---|---|---|
| | | 100 | 120 | 140 | 160 | 180 | 200 | 220 | 240 |
| | | Sensor-sensing voltage Vd(V) | | | | | | | |
| 1 | 3.2721 | 3.2690 | 3.2681 | 3.2669 | 3.2655 | 3.2637 | 3.2615 | 3.2590 | 3.2560 |
| 10 | 3.2472 | 3.2422 | 3.2407 | 3.2388 | 3.2364 | 3.2334 | 3.2299 | 3.2257 | 3.2207 |
| 20 | 3.2049 | 3.1974 | 3.1950 | 3.1920 | 3.1882 | 3.1835 | 3.1780 | 3.1714 | 3.1637 |
| 30 | 3.1366 | 3.1261 | 3.1226 | 3.1180 | 3.1123 | 3.1054 | 3.0972 | 3.0875 | 3.0763 |
| 40 | 3.0325 | 3.0189 | 3.0140 | 3.0075 | 2.9995 | 2.9897 | 2.9782 | 2.9648 | 2.9492 |
| 50 | 2.8832 | 2.8670 | 2.8605 | 2.8519 | 2.8413 | 2.8285 | 2.8134 | 2.7858 | 2.7757 |
| 60 | 2.6829 | 2.6657 | 2.6575 | 2.6469 | 2.6338 | 2.6181 | 2.5996 | 2.5784 | 2.5542 |
| 70 | 2.4333 | 2.4171 | 2.4077 | 2.3955 | 2.3805 | 2.3626 | 2.3418 | 2.3179 | 2.2909 |
| 80 | 2.1455 | 2.1327 | 2.1226 | 2.1097 | 2.0937 | 2.0749 | 2.0530 | 2.0282 | 2.0004 |
| 90 | 1.8387 | 1.8311 | 1.8210 | 1.8082 | 1.7925 | 1.7741 | 1.7529 | 1.7289 | 1.7023 |
| 100 | 1.5354 | 1.5354 | 1.5239 | 1.5120 | 1.4977 | 1.4808 | 1.4616 | 1.4400 | 1.4162 |
| 110 | 1.2545 | | 1.2493 | 1.2389 | 1.2264 | 1.2119 | 1.1955 | 1.1771 | 1.1569 |
| 120 | 1.0084 | | 1.0084 | 0.9997 | 0.9894 | 0.9775 | 0.9641 | 0.9495 | 0.9328 |
| 130 | 0.8019 | | | 0.7986 | 0.7904 | 0.7809 | 0.7703 | 0.7587 | 0.7459 |
| 140 | 0.6339 | | | | 0.6280 | 0.6207 | 0.6126 | 0.6037 | 0.5940 |
| 150 | 0.5001 | | | | 0.4982 | 0.4926 | 0.4865 | 0.4799 | 0.4727 |

As shown in the table 1, the temperature characteristic table of the contactless temperature sensor is provided in a two-dimensional form having an abscissa and an ordinate. The abscissa indicates the sensor-sensing voltage NCTH_D and the ordinate indicates the sensor-compensating voltage (NCTH_C). The voltage is in inverse proportion to the temperature.

The temperature of the fixing unit 140 may be determined by comparing the sensor-compensating voltage and the sensor-sensing voltage sensed by the contactless sensor 210 with the temperature characteristic table. For example, if the sensor-sensing voltage is 3.1950V and the sensor-compensating voltage is 3.2049V, the temperature of the fixing unit 140 is 120° C.

Referring to table 1, the sensor-sensing voltage is lower than or equal to the sensor-compensating voltage in a normal state. In other words, it will be appreciated that the sensor-compensating voltage is higher than or equal to the sensor-sensing voltage.

The power supply 250 supplies operation power to the elements of the image forming apparatus. Specifically, the power supply 250 controls power supplied to the fixing unit 140 under control of the controller 270.

The controller 270 controls power-on/off based on a fixing algorithm so that the fixing unit 140 can maintain a proper fixing temperature on the basis of voltage sensed by the contactless sensor 210.

If the fixing unit 140 is powered on, alternating current power is applied to the fixing unit 140 and thus the temperature of the fixing unit 140 increases. If it is determined that the temperature is excessively increased on the basis of the voltage sensed by the contactless sensor 210, the controller 140 shuts off the power supplied to the fixing unit 140.

The controller 270 is achieved by a central processing unit (CPU) for controlling general operation of the image forming apparatus 100, which may include an ADC block 271 for converting a sensed voltage value (e.g., the sensor-sensing voltage and the sensor-compensating voltage) into a temperature value.

Figure 5:
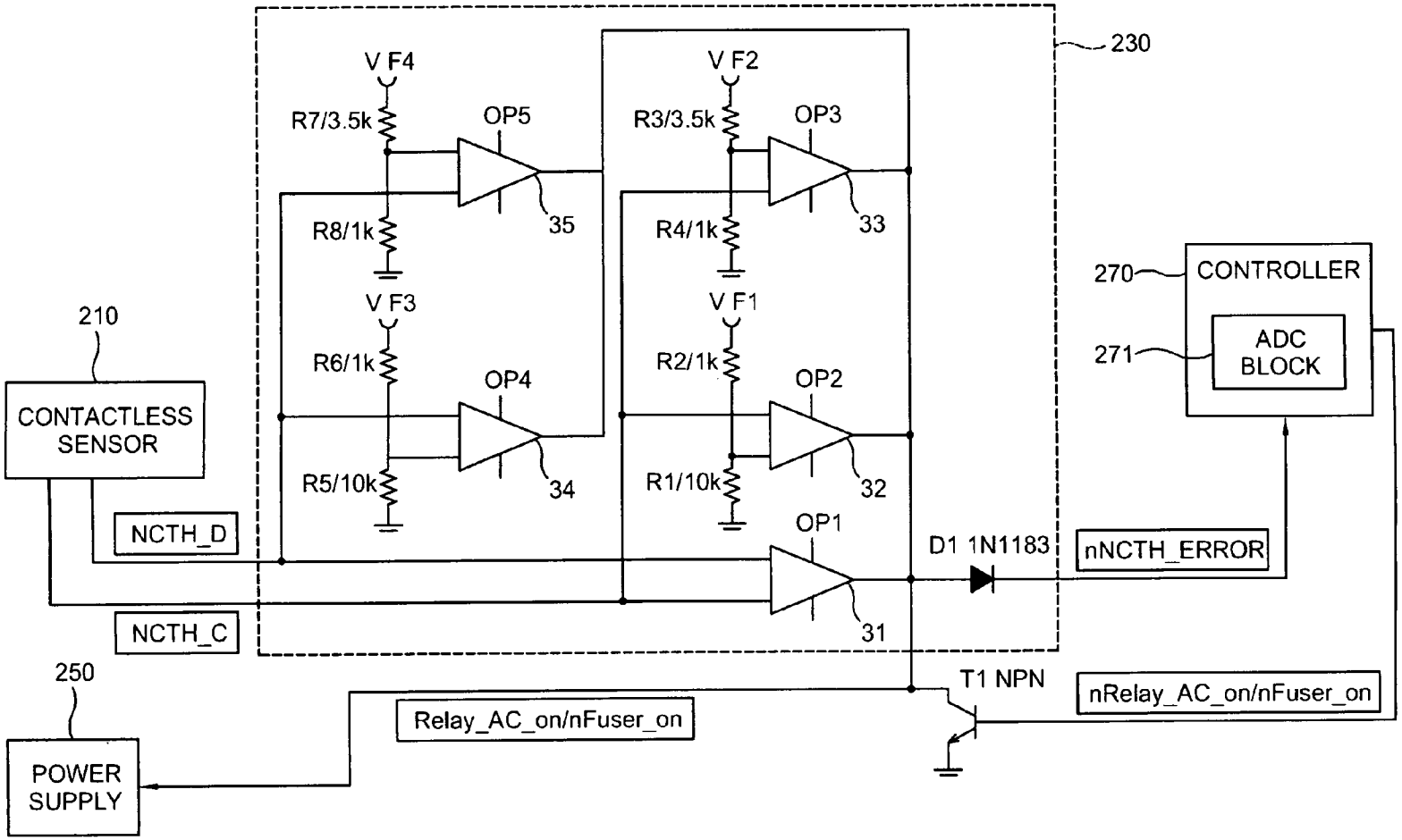
FIG. 5 is a circuit diagram of a contactless-sensing protector according to an exemplary embodiment.

FIG. 5 is a circuit diagram of the contactless-sensing protector 230 according to an exemplary embodiment.

As shown in FIG. 5, the contactless-sensing protector 230 includes a first comparator 31 to which the sensor-sensing voltage and the sensor-compensating voltage are input, and second, third, fourth and fifth comparators 32, 33, 34 and 35 to which one of the sensor-sensing voltage and the sensor-compensating voltage and a voltage set as an upper limit value or a lower limit value of one of the sensor-sensing voltage and the sensor-compensating voltage are input.

The first comparator 31 receives the sensor-sensing voltage NCTH_D and the sensor-compensating voltage NCTH_C from the contactless sensor 210, and outputs an error signal (e.g., a low signal) for shutting off the power supplied to the fixing unit 140 if the sensor-sensing voltage is higher than the sensor-compensating voltage.

Specifically, in a normal state as shown in the table 1, the sensor-sensing voltage is lower than or equal to the sensor-compensating voltage, and the first comparator 31 outputs a high signal. If the sensor-sensing voltage is higher than the sensor-compensating voltage, the first comparator 31 outputs the low signal.

The second comparator 32 receives the sensed sensor-compensating voltage NCTH_C and a preset upper limit value of the sensor-compensating voltage, and outputs an error signal (e.g., a low signal) if the sensor-compensating voltage is higher than the preset upper limit value.

Here, the upper limit value of the sensor-compensating voltage is determined on the basis of the temperature characteristic table of the table 1. Specifically, since the highest sensor-compensating voltage is 3.2721V in the table 1, the upper limit value may be set as 3.2722V.

The third comparator 33 receives the sensed sensor-compensating voltage NCTH_C and a preset lower limit value of the sensor-compensating voltage, and outputs an error signal (e.g., a low signal) if the sensor-compensating voltage is lower than the preset lower limit value.

Here, the lower limit value of the sensor-compensating voltage is determined on the basis of the temperature characteristic table of the table 1. Specifically, since the lowest sensor-compensating voltage is 0.5001V in the table 1, the lower limit value may be set as 0.5V.

The fourth comparator 34 receives the sensed sensor-sensing voltage NCTH_D and a preset upper limit value of the sensor-sensing voltage, and outputs an error signal (e.g., a low signal) if the sensor-sensing voltage is higher than the preset upper limit value.

Here, the upper limit value of the sensor-sensing voltage is determined on the basis of the temperature characteristic table of the table 1. Specifically, since the highest sensor-sensing voltage is 3.2690V in the table 1, the upper limit value may be set as 3.27V.

The fifth comparator 35 receives the sensed sensor-sensing voltage NCTH_D and a preset lower limit value of the sensor-sensing voltage, and outputs an error signal (e.g., a low signal) if the sensor-sensing voltage is lower than the preset lower limit value.

Here, the lower limit value of the sensor-sensing voltage is determined on the basis of the temperature characteristic table of the table 1. Specifically, since the lowest sensor-sensing voltage is 0.4727V in the table 1, the lower limit value may be set as 0.4V. As necessary, the sensor-compensating voltage and the lower limit value of the sensor-sensing voltage may be set as 0V.

Thus, if at least one of the sensor-compensating voltage NCTH_C and the sensor-sensing voltage NCTH_D sensed by the contactless sensor 210 is beyond the range of the temperature characteristic table of the table 1, at least one among the second to fifth comparators 32, 33, 34 and 35 of the contactless-sensing protector 230 outputs the low signal as an error signal, thereby shutting off the power supplied to the fixing unit 140.

In result, even if the output of the contactless sensor 210 becomes a high latch up (3.3V) or a low latch up (0V), the power supplied to the fixing unit 140 is shut off in hardware by at least one among the second to fifth comparators 32, 33, 34 and 35, thereby protecting the fixing unit 140.

According to an exemplary embodiment, the first to fifth comparators 31, 32, 33, 34 and 35 output the high signal in the normal state and output the low signal as the error signal when the temperature of the fixing unit 140 is abnormal, but the invention is not limited thereto.

Meanwhile, the output of the contactless-sensing protector 230 is input to the controller 270.

In detail, if at least one of the first to fifth comparators 31, 32, 33, 34 and 35 outputs the error signal nNCTH_ERROR, the ADC block of the controller 270 receives and converts the error signal into a temperature value so that the controller 270 can control the fixing unit 140 to stop operating in accordance with the fixing algorithm.

The contactless-sensing protector 230 shuts off in hardware the power supplied from the power supply 250 to the fixing unit 140 regardless of the control for the fixing unit 140 in the controller 270 if at least one of the first to fifth comparators 31, 32, 33, 34 and 35 outputs the error signal.

Accordingly, the fixing unit 140 is protected even though the controller 270 cannot normally perform the fixing algorithm due to error.

Figure 6:
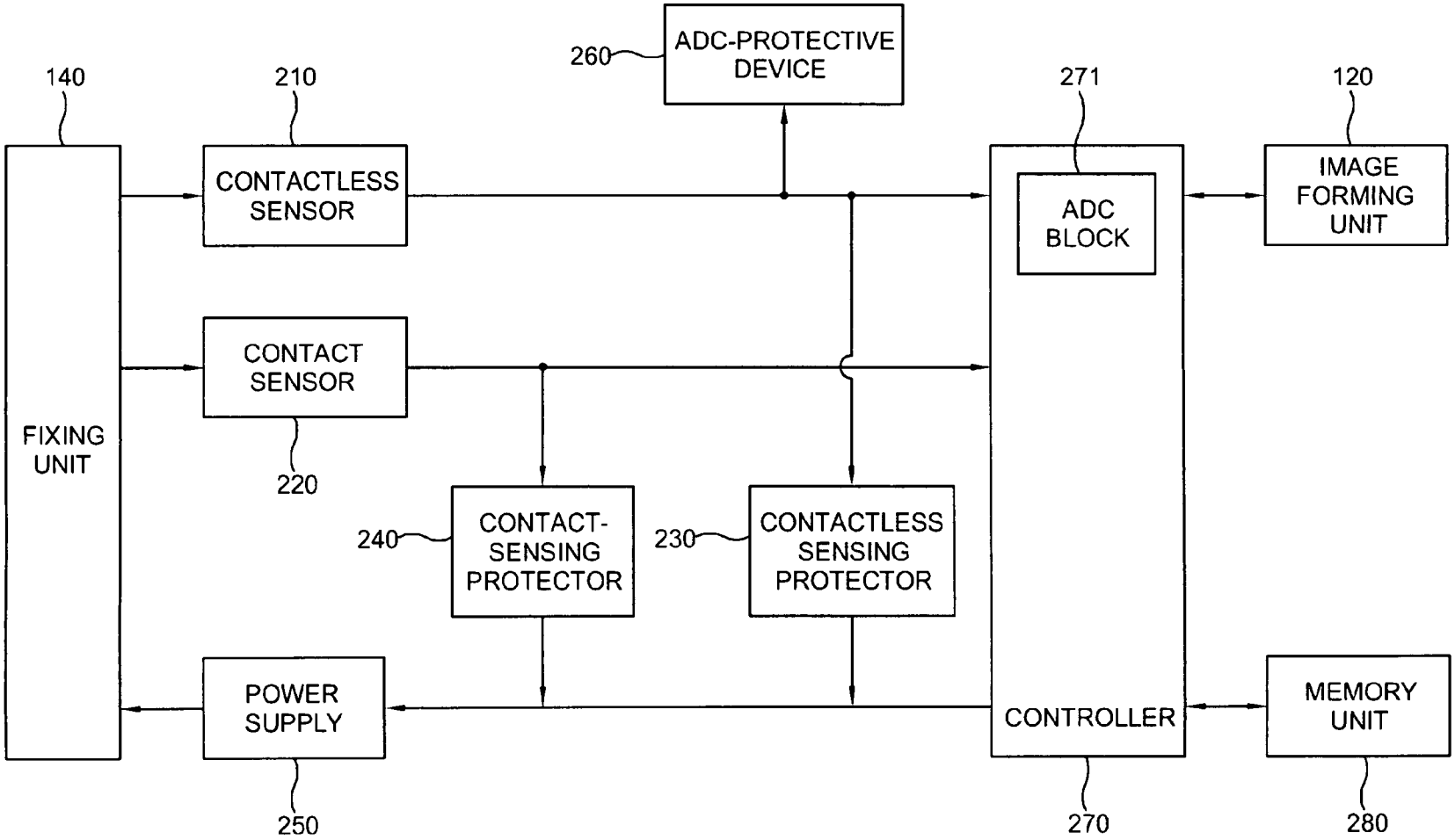
FIG. 6 is a block diagram showing a configuration of an image forming apparatus according to another exemplary embodiment.

FIG. 6 is a block diagram showing a configuration of an image forming apparatus according to another exemplary embodiment.

Referring to FIG. 6, the image forming apparatus in this exemplary embodiment is different from that of the foregoing exemplary embodiment in also including a contact sensor 220 and a contact-sensing protector 240.

Thus, reference numerals and terms of other elements except the contact sensor 220 and the contact-sensing protector 240 are the same as those in the foregoing exemplary embodiment, and repetitive descriptions thereof will be avoided as necessary.

In the meantime, the image forming apparatus in this exemplary embodiment may further include an electrostatic discharge (ESD) or an ADC-protective device 260 for preventing the electric noise.

Figure 7:
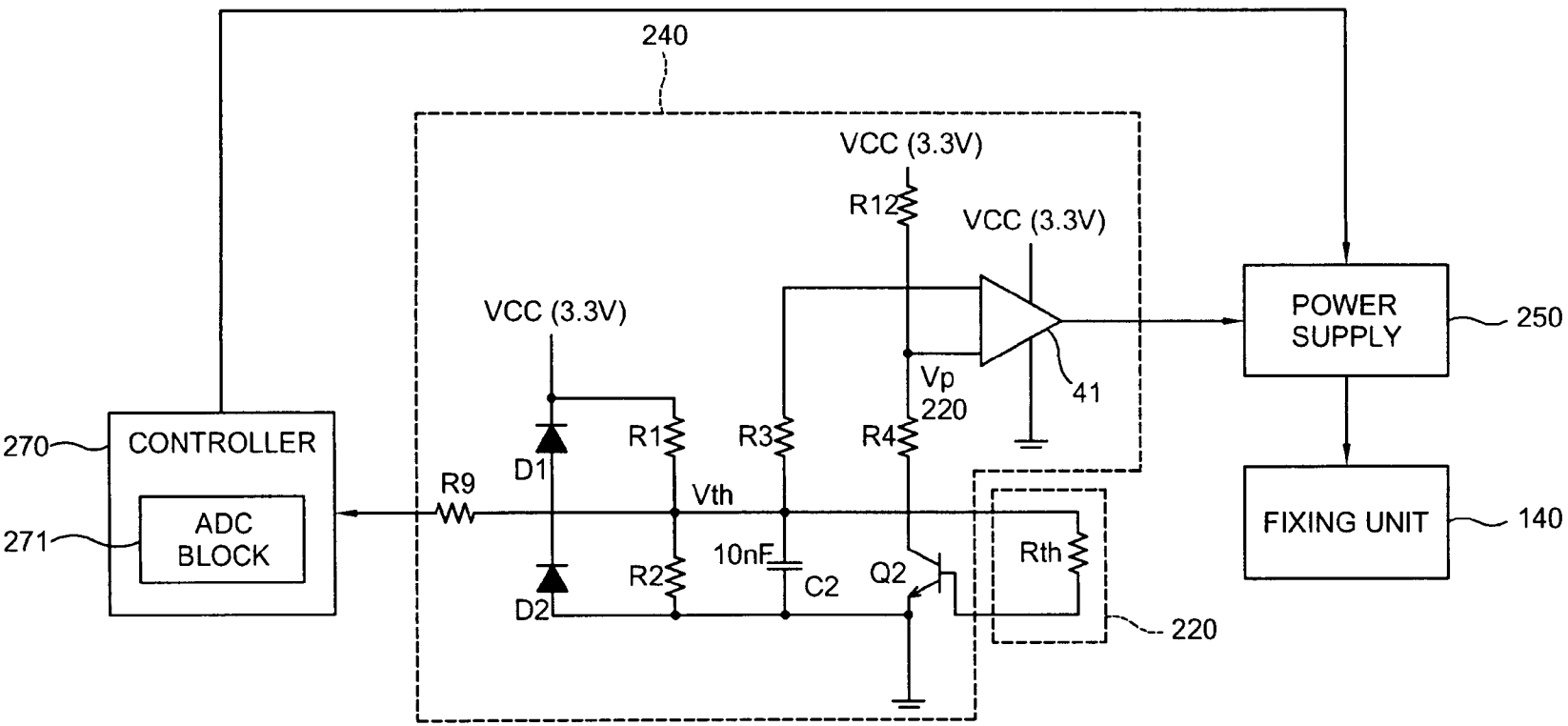
FIG. 7 is a circuit diagram of a contactless-sensing protector according to another exemplary embodiment.

FIG. 7 is a circuit diagram of a contactless-sensing protector according to another exemplary embodiment.

As shown in FIG. 7, the contact sensor 220 includes a thermistor Rth as a thermal resistor contacting the fixing roller, and senses the temperature of the fixing unit 140 by a contact method, thereby outputting a contact-sensing voltage.

The contact sensor 220 reads the resistance of the thermistor Rth and senses the temperature of the fixing unit 140, and the resistance is converted into a voltage (contact-sensing voltage) and transmitted to the controller 270 via the ADC block 271.

The controller 270 converts the contact-sensing voltage into a temperature value and controls the fixing unit 140 to maintain a proper temperature by powering on/off the fixing unit 140 in accordance with the fixing algorithm.

The contact-sensing protector 240 shuts off the power supplied from the power supply 250 to the fixing unit 140 if the contact-sensing voltage is higher than a predetermined reference voltage.

Specifically, as shown in FIG. 7, the contact-sensing protector 240 includes a sixth comparator 41 that receives the contact-sensing voltage Vp and the reference voltage, and outputs a comparison result between the input contact-sensing voltage and reference voltage. The sixth comparator 41 outputs an error signal (e.g., a low signal) for shutting off the power supplied to the fixing unit if the contact-sensing voltage is higher than the reference voltage. Here, the reference voltage may be arbitrarily set (e.g., to 1.65V).

Meanwhile, the output of the contact-sensing protector 240 is input to the controller 270.

In detail, if the sixth comparator 41 outputs the error signal, the ADC block of the controller 270 receives and coverts the error signal into the temperature value so that the controller 270 can control the fixing unit 140 to stop operating in accordance with the fixing algorithm.

The contact-sensing protector 240 shuts off in hardware the power supplied from the power supply 250 to the fixing unit 140 regardless of the control for the fixing unit 140 in the controller 270 if the sixth comparator 41 outputs the error signal.

Accordingly, the fixing unit 140 is protected even though the controller 270 cannot normally perform the fixing algorithm due to error.

In the image forming apparatus according to this exemplary embodiment, if at least one of the contactless-sensing protector 230 and the contact-sensing protector 240 outputs the error signal, the power supplied to the fixing unit 140 is shut off.

Also, the controller 270 controls the fixing unit 140 to stop operating on the basis of the output signal from at least one of the contactless-sensing protector 230 and the contact-sensing protector 240.

Accordingly, the fixing unit 140 is prevented from overheating by the contactless-sensing protector 230 as well as the existing contact-sensing protector 240.

Further, when the fixing unit 140 is overheated, at least one of the contactless-sensing protector 230 and the contact-sensing protector 240 can shut off the power in hardware regardless of a fixing control signal of the controller 270, thereby more effectively protecting the fixing unit 140.

In the image forming apparatus with the above configuration, a fixing unit control method thereof will be described with reference to FIGS. 8, 9 and 10.

Figure 8:
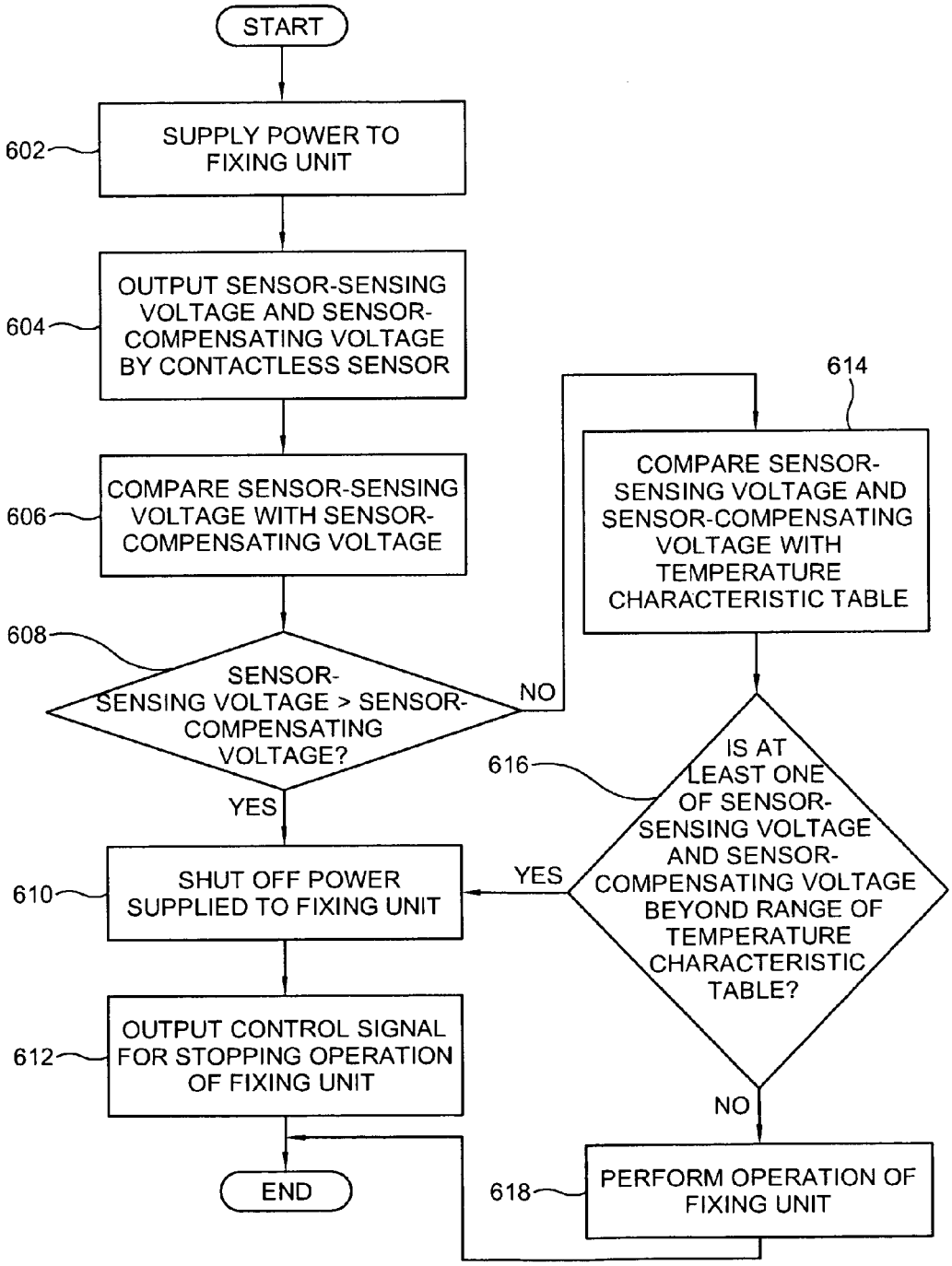
FIG. 8 is a flowchart showing a fixing unit control method of an image forming apparatus according to an exemplary embodiment.

FIG. 8 is a flowchart showing a fixing unit control method of an image forming apparatus according to an exemplary embodiment.

In the image forming apparatus of FIG. 8, the contactless sensor 210 and the contactless-sensing protector 230 are provided as shown in FIG. 4.

Referring to FIG. 8, at operation 602, power is supplied to the fixing unit 140 for fixing an image when the image forming apparatus performs printing in response to a received printing command.

When the power is supplied to the fixing unit 140, temperature increases and the contactless sensor 210 senses and outputs the sensor-sensing voltage and the sensor-compensating voltage at operation 604.

At operation 606, the contactless-sensing protector 230 compares the sensed sensor-sensing voltage and the sensor-compensating voltage.

That is, at operation 608, the first comparator 31 of the contactless-sensing protector 230 receives the sensor-sensing voltage NCTH_D and the sensor-compensating voltage NCTH_C and compares the levels of them.

In the operation 608, if the sensor-sensing voltage is higher than the sensor-compensating voltage, the first comparator 31 outputs the low signal, so that the power supplied from the power supply 250 to the fixing unit 140 is shut off at operation 610. Thus, the fixing unit 140 is prevented from overheating regardless of software control for the fixing unit 140 in the controller 270.

In addition, if the sensor-sensing voltage is higher than the sensor-comparing voltage, the controller 270 outputs a control signal for stopping the operation of the fixing unit 140 at operation 612.

Meanwhile, the contactless-sensing protector 230 compares the sensor-sensing voltage and the sensor-compensating voltage sensed in the operation 604 with the temperature characteristic table such as the table 1 at operation 614. Regardless of the comparison results in the operation 608, the operation 614 is performed in parallel with the operation 616 on the basis of the sensing results in the operation 604.

That is, at operation 616, the contactless-sensing protector 230 respectively compares the sensor-sensing voltage and the sensor-compensating voltage with the upper limit value and the lower limit value set up with respect to each of them, and determines whether the sensor-sensing voltage and the sensor-compensating voltage are within the range based on the temperature characteristic table. Here, when at least one among the second to fifth comparators 32, 33, 34 and 35 of the contactless-sensing protector 230 outputs the low signal, it means that one of the sensor-compensating voltage and the sensor-sensing voltage is beyond the range of the temperature characteristic table.

In the operation 616, if it is determined that at least one of the sensor-sensing voltage and the sensor-compensating voltage is beyond the range of the temperature characteristic table, the power supplied from the power supply 250 to the fixing unit 140 is shut off at operation 610. Thus, the fixing unit 140 is prevented from overheating regardless of the software control for the fixing unit 140 in the controller 270.

If both the sensor-sensing voltage and the sensor-compensating voltage are within the temperature characteristic table in the operation 616 and the sensor-sensing voltage is equal to or lower than the sensor-compensating voltage in the operation 608, the fixing unit 140 normally operates under control of the controller 270 at operation 618.

Figure 9:
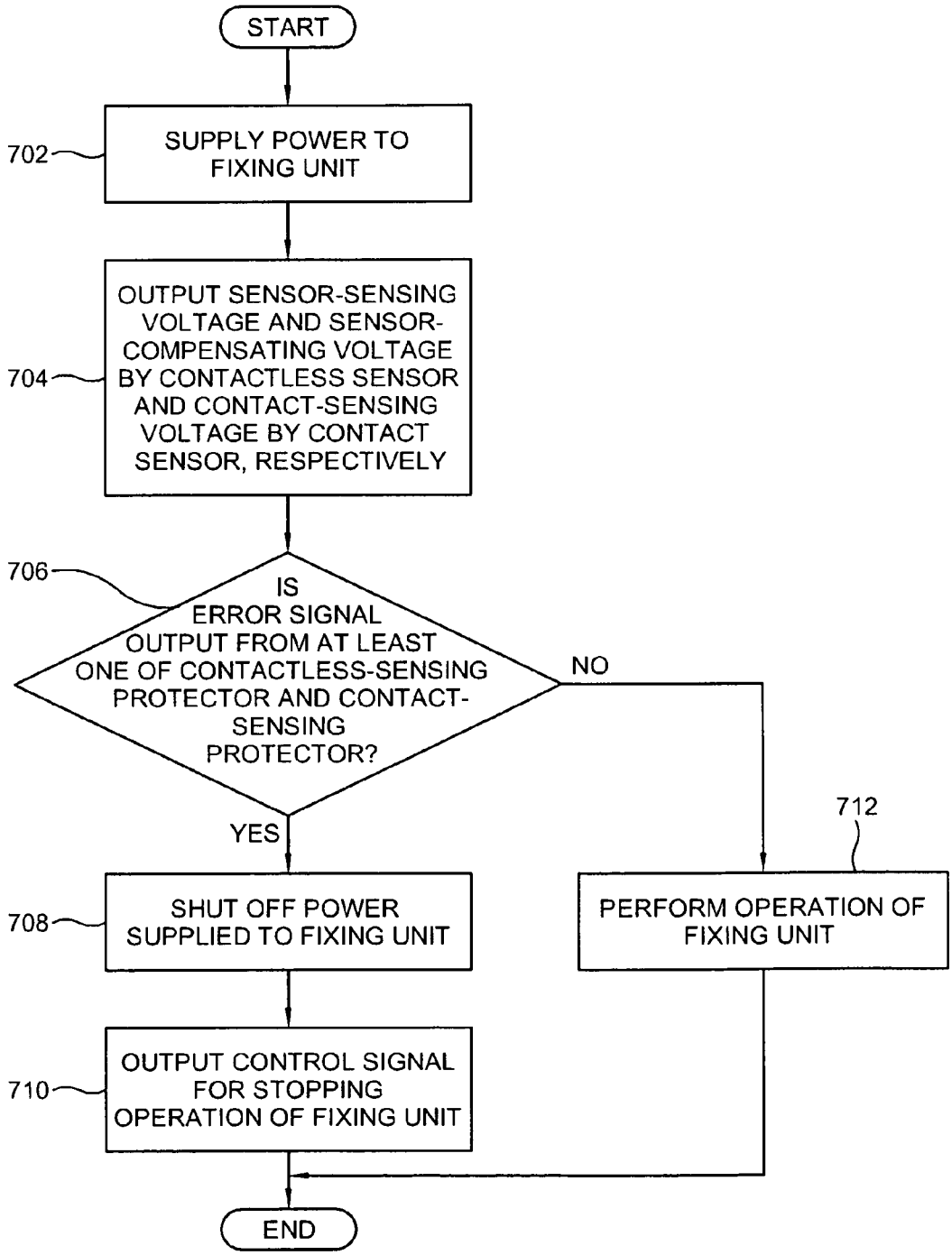
FIG. 9 is a flowchart showing a fixing unit control method of an image forming apparatus according to another exemplary embodiment.

FIG. 9 is a flowchart showing a fixing unit control method of an image forming apparatus according to another exemplary embodiment. The image forming apparatus according to the exemplary embodiment of FIG. 9 further includes the contact sensor 220 and the contact-sensing protector 240 in addition to the contactless sensor 210 and the contactless-sensing protector 230 as shown in FIG. 6.

Referring to FIG. 9, at operation 702, power is supplied to the fixing unit 140 for fixing an image when the image forming apparatus performs printing in response to a received printing command.

When the power is supplied to the fixing unit 140, temperature increases and the contactless sensor 210 senses and outputs the sensor-sensing voltage and the sensor-compensating voltage and the contact sensor 220 senses the contact-sensing voltage at operation 704.

At operation 706, the image forming apparatus determines whether at least one of the contactless-sensing protector 230 and the contact-sensing protector 240 outputs the error signal on the basis of the voltage output in the operation 704.

Here, the contactless-sensing protector 230 outputs the error signal if at least one of the first to fifth comparators 31, 32, 33, 34 and 35 outputs the low signal, and the contact-sensing protector 240 outputs the error signal if the sixth comparator outputs the low signal. The output of the error signal in the contact-sensing protector 240 will be described below in more detail with reference to FIG. 10.

If at least one of the contactless-sensing protector 230 and the contact-sensing protector 240 outputs the error signal in the operation 706, the power supplied from the power supply 250 to the fixing unit 140 is shut off at operation 708. Accordingly, the fixing unit 140 is prevented from overheating irrespective of the software control for the fixing unit 140 in the controller 270. In addition, the controller 270 outputs a control signal for stopping the operation of the fixing unit at operation 710.

If both the contactless-sensing protector 230 and the contact-sensing protector 240 do not output the error signal in the operation 706, that is, if the contact-sensing voltage is lower than and equal to the reference voltage, both the sensor-sensing voltage and the sensor-compensating voltage are within the temperature characteristic table, and the sensor-sensing voltage is lower than and equal to the sensor-compensating voltage, the fixing unit 140 normally operates under control of the controller 270 at operation 712.

Figure 10:
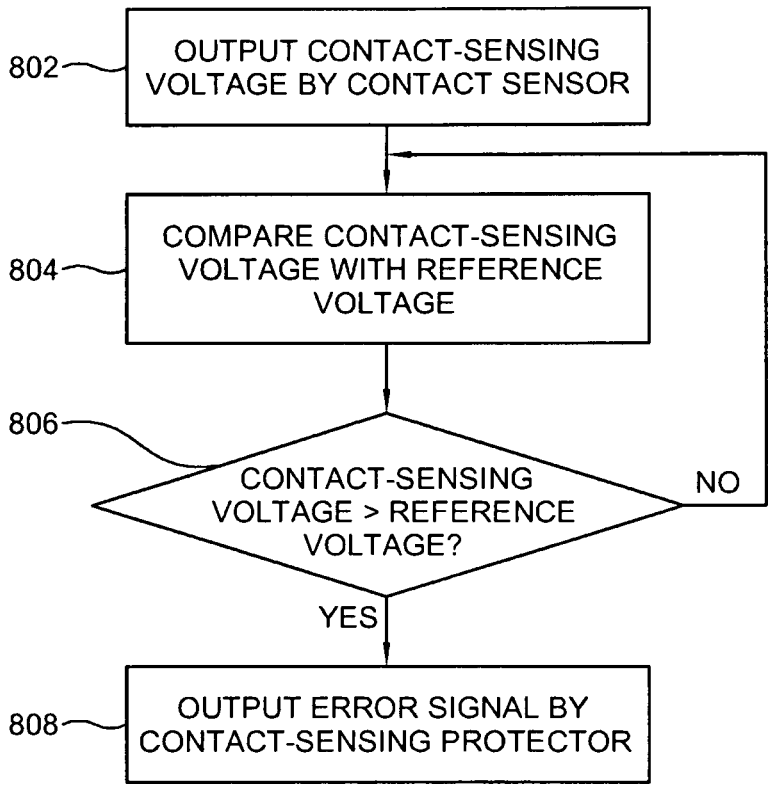
FIG. 10 is a flowchart showing an error signal output method of a contact-sensing protector according to the exemplary embodiment of FIG. 9.

FIG. 10 is a flowchart showing an error signal output method of the contact-sensing protector 240 according to an exemplary embodiment of FIG. 9.

At operation 802, the contact sensor 220 senses and outputs the contact-sensing voltage.

At operation 804, the contact-sensing protector 240 compares the sensed contact-sensing voltage with a predetermined reference voltage at operation 804.

Specifically, the sixth comparator 41 receives the contact-sensing voltage and the reference voltage, and outputs the low signal if the contact-sensing voltage is higher than the reference voltage at operation 806.

If the low signal is output in the operation 806, the contact-sensing protector 240 outputs the error signal at operation 808.

As described above, a contactless-sensing protector for sensing a fixing temperature by a contactless method and shutting off power in hardware is provided to prevent overheating and a control error and protect a fixing unit.

Also, it is possible to more effectively protect a fixing unit by not only shutting off power on the basis of comparison between a sensor-sensing voltage and a sensor-compensating voltage but also shutting off the power even when at least one of the sensor-sensing voltage and the sensor-compensating voltage is beyond a temperature range.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. An image forming apparatus comprising:

an image forming unit which forms an image;

a fixing unit which fixes the image transferred to a printing medium;

a power supply which supplies operation power to the fixing unit;

a contactless sensor which comprises a pair of sensors sensing a temperature of the fixing unit by a contactless method and respectively outputting a sensor-sensing voltage and a sensor-compensating voltage;

a contactless-sensing protector which shuts off the power if the sensor-sensing voltage is higher than the sensor-compensating voltage;

a contact sensor which senses the temperature of the fixing unit by a contact method and outputs a contact-sensing voltage; and a contact-sensing protector which shuts off the power if the contact-sensing voltage is higher than a predetermined reference voltage.

2. The image forming apparatus according to claim 1, wherein the contactless-sensing protector comprises a first comparator to receive the sensor-sensing voltage and the sensor-compensating voltage and output a comparison result between the received sensor-sensing voltage and sensor-compensating voltage.

3. The image forming apparatus according to claim 1, further comprising a memory unit to store a temperature characteristic table about the sensor-sensing voltage and the sensor-compensating voltage, wherein the contactless-sensing protector compares the sensor-sensing voltage and the sensor-compensating voltage output from the contactless sensor with the temperature characteristic table, and shuts off the power if at least one of the output sensor-sensing voltage or sensor-compensating voltage is beyond a range of the temperature characteristic table stored in the memory unit.

4. The image forming apparatus according to claim 3, wherein the contactless-sensing protector comprises a plurality of comparators that receives one of the sensor-sensing voltage and the sensor-compensating voltage, and a voltage set up as an upper limit value or a lower limit value of one of the sensor-sensing voltage and the sensor-compensating voltage.

5. The image forming apparatus according to claim 4, wherein the plurality of comparators comprises a second comparator which receives the output sensor-compensating voltage and the set up upper limit value of the sensor-compensating voltage, and outputs an error signal if the output sensor-compensating voltage is higher than the upper limit value;

a third comparator which receives the output sensor-compensating voltage and the set up lower limit value of the sensor-compensating voltage, and outputs an error signal if the output sensor-compensating voltage is lower than the lower limit value;

a fourth comparator which receives the output sensor-sensing voltage and the set up upper limit value of the sensor-sensing voltage, and outputs an error signal if the output sensor-sensing voltage is higher than the upper limit value; and a fifth comparator which receives the output sensor-sensing voltage and the set up lower limit value of the sensor-sensing voltage, and outputs an error signal if the output sensor-sensing voltage is lower than the lower limit value, and the contactless-sensing protector shuts off the power if at least one of the second to fifth comparators outputs the error signal.

6. The image forming apparatus according to claim 1, further comprising a controller which receives a signal from the contactless-sensing protector and controls operation of the fixing unit.

7. The image forming apparatus according to claim 1, wherein the contact-sensing protector comprises a sixth comparator which receives the contact-sensing voltage and the reference voltage and outputs a comparison result between the received contact-sensing voltage and reference voltage.

8. The image forming apparatus according to claim 1, further comprising a controller which receives signals from the contactless-sensing protector and the contact-sensing protector and controls operation of the fixing unit, wherein the controller controls the fixing unit to stop operating on the basis of a signal output from at least one of the contactless-sensing protector or the contact-sensing protector.

9. A fixing unit control method of an image forming apparatus comprising an image forming unit to form an image, a fixing unit to fix the image transferred on a printing medium, and a power supply to supply operation power to the fixing unit, the fixing unit control method comprising:

sensing a temperature of the fixing unit by a contactless method and outputting a sensor-sensing voltage and a sensor-compensating voltage;

comparing the sensor-sensing voltage with the sensor-compensating voltage;

shutting off the power if the sensor-sensing voltage is higher than the sensor-compensating voltage;

sensing the temperature of the fixing unit by a contact method and outputting a contact-sensing voltage;

comparing the contact-sensing voltage and a predetermined reference voltage; and shutting off the power if the contact-sensing voltage is higher than the reference voltage.

10. The fixing unit control method according to claim 9, wherein the image forming unit further comprises a memory unit to store a temperature characteristic table about the sensor-sensing voltage and the sensor-compensating voltage, the fixing unit control method further comprising:

comparing the output sensor-sensing voltage and sensor-compensating voltage with the temperature characteristic table; and shutting off the power if at least one of the output sensor-sensing voltage or sensor-compensating voltage is beyond a range of the temperature characteristic table stored in the memory unit.

11. The fixing unit control method according to claim 10, wherein the comparison with the temperature characteristic table comprises comparing one of the sensor-sensing voltage and the sensor-compensating voltage with a voltage set up as an upper limit value or a lower limit value of one of the sensor-sensing voltage and the sensor-compensating voltage.

12. The fixing unit control method according to claim 11, wherein the comparison with the voltage set up as the upper limit value or the lower limit value comprises:

a first operation of comparing the output sensor-compensating voltage with the set up upper limit value of the sensor-compensating voltage, and outputting an error signal if the output sensor-compensating voltage is higher than the upper limit value;

a second operation of comparing the output sensor-compensating voltage with the set up lower limit value of the sensor-compensating voltage, and outputting an error signal if the output sensor-compensating voltage is lower than the lower limit value;

a third operation of comparing the output sensor-sensing voltage with the set up upper limit value of the sensor-sensing voltage, and outputting an error signal if the output sensor-sensing voltage is higher than the upper limit value; and a fourth operation of comparing the output sensor-sensing voltage with the set up lower limit value of the sensor-sensing voltage, and outputting an error signal if the output sensor-sensing voltage is lower than the lower limit value.

13. The fixing unit control method according to claim 12, wherein the shutting off the power comprises shutting off the power unit if the error signal is output in at least one of the first to fourth operations.

14. The fixing unit control method according to claim 9, further comprising outputting a control signal for stopping operation of the fixing unit if the sensor-sensing voltage is higher than the sensor-compensating voltage.

15. The fixing unit control method according to claim 9, further comprising a control signal for stopping operation of the fixing unit if the contact-sensing voltage is lower than or equal to the reference voltage.

* * * * *